US007785239B2

(12) United States Patent
Daniel

(10) Patent No.: US 7,785,239 B2
(45) Date of Patent: Aug. 31, 2010

(54) MAGNETICALLY ADJUSTABLE DUMBBELLS

(76) Inventor: Nir Daniel, 3 Belkind Street, Tel-Aviv 69154 (IL)

( * ) Notice: Subject to any disclaimer, the term of this patent is extended or adjusted under 35 U.S.C. 154(b) by 0 days.

(21) Appl. No.: 12/280,215

(22) PCT Filed: Feb. 13, 2007

(86) PCT No.: PCT/IL2007/000198

§ 371 (c)(1),
(2), (4) Date: Aug. 21, 2008

(87) PCT Pub. No.: WO2007/096864

PCT Pub. Date: Aug. 30, 2007

(65) Prior Publication Data

US 2009/0048080 A1 Feb. 19, 2009

Related U.S. Application Data

(60) Provisional application No. 60/774,661, filed on Feb. 21, 2006.

(51) Int. Cl.
*A63B 21/072* (2006.01)
*A63B 21/06* (2006.01)

(52) U.S. Cl. ..... 482/108; 482/93

(58) Field of Classification Search ..... 482/92–94, 482/106–109
See application file for complete search history.

(56) References Cited

U.S. PATENT DOCUMENTS

| | | | | | |
|---|---|---|---|---|---|
| 4,462,596 | A | * | 7/1984 | Yamamoto | 273/239 |
| 4,971,305 | A | | 11/1990 | Rennex | |
| 5,256,121 | A | * | 10/1993 | Brotman | 482/93 |
| 5,348,522 | A | * | 9/1994 | Brotman | 482/98 |
| 5,735,777 | A | * | 4/1998 | Benoit et al. | 482/93 |
| 2003/0017919 | A1 | | 1/2003 | Lanoue | |

FOREIGN PATENT DOCUMENTS

JP 8332245 12/1996

OTHER PUBLICATIONS

International Search Report of Application No. PCT/IL2007/000198 mailed on May 19, 2008.

* cited by examiner

*Primary Examiner*—Fenn C Mathew
(74) *Attorney, Agent, or Firm*—Pearl Cohen Zedek Latzer, LLP

(57) ABSTRACT

A magnetically dumbbell device and method are disclosed. The dumbbell device has a central base unit with at least one magnetic piece at each end of the base unit and one or more weights attachable to the ends of the base unit by means of magnetic force.

11 Claims, 4 Drawing Sheets

MAGNETICALLY ADJUSTABLE DUMBBELLS

CROSS-REFERENCE TO RELATED APPLICATIONS

This application is a National Phase Application of PCT International Application No. PCT/IL2007/000198, International Filing Date Feb. 13, 2007, entitled "Magnetically Adjustable Dumbbells" published on Aug. 30, 2007 as International Publication Number WO 2007/096864 claiming priority of U.S. Provisional Patent Application No., 60/774,661, filed Feb. 21, 2006, both of which are incorporated herein by reference in their entirety.

FIELD OF THE INVENTION

The present invention relates to dumbbells for developing arm strength and more particularly to a method and device providing magnetically adjustable dumbbells.

BACKGROUND OF THE INVENTION

The present art provides dumbbells with adjustable weight. Usually the installing and removing of the additional weights is inconvenient and takes time. Making the removal of the weights easier may come at the sacrifice of the linkage strength between the additional weights to the dumbbell, and therefore may be unsafe, because of the danger that an additional weight will fall from the dumbbell while exercising.

A worm-based mechanism is a known method for installing and removing addable weights.

Using attraction force of magnets is a known method for attaching additional weights.

JP8332245 provides a dumbbell of a weight increasing and decreasing mechanism which can increase and decrease the weight of the dumbbell freely, making use of attraction force of a ferrite magnet, and trains a hand and an arm and promotes circulation of the blood.

None of the known art provides a method which enables installation of additional weights simply by attaching them with magnets and easy removal of the additional weights by rotation, without sacrificing the magnetic linkage force between the additional weights and the dumbbell.

It is therefore desired to have a device and method providing dumbbells with an easy-to-operate mechanism for installing and removing the additional weights, which enables strong and safe linkage between the additional weights to the dumbbell, while providing the comfort of using magnets for attaching the additional weights.

SUMMARY OF THE INVENTION

The method and device of the present invention provides magnetically adjustable dumbbells which enables installing additional weights magnetically and removing them easily using rotational motion.

The method and device of the present invention have the advantage of using rotational motion for detaching the additional weights from the dumbbells. In this method, the linkage between the additional weights and the dumbbell may be strong and safe while the releasing of the additional weights from the dumbbell may be easy and may not require usage of great force.

This invention provides a device comprising a base dumbbell. The base dumbbell may comprise at least one magnet chip within a surface to which an addable weight can be attached. The device may further comprise an addable weight which may be made of un-magnetizable material. The addable weight may comprise at least one magnetizable chip. When comprising more then one magnetizable chip, the magnetizable chips may be located over an imaginary circle in correspondence with a same amount of magnet chips within the attaching surface. The addable weight can be attached to the base dumbbell by coupling said magnetizable chip to said magnet chip. Rotation of said addable weight relatively to said surface may detach said magnetizable chip from said magnet chip using shearing force and may locate the magnet chip against the un-magnetizable material, and thus the addable weight may be released and removed easily from the base dumbbell. The rotation of said addable weight may be about a pivot located at the center of said surface. At least one addable weight may be arranged about said pivot, and preferably more then one. The perimeter of said addable weight may be jagged in order to facilitate easy gripping and rotating of said addable weight.

An additional addable weight may be attached to each addable weight. Each addable weight may comprise a central pivot that one or more additional addable weights may be adapted to rotate about. Each additional addable weight may require less releasing force then the addable weight it is added to. Smaller required releasing force may be provided by fewer magnets in the additional addable weight then in the addable weight it is added to, or by weaker magnets in the additional addable weight then in the addable weight it is added to.

This invention further provides a method for removing an addable weight from a base dumbbell. In order to release said addable weight from said base dumbbell it is possible to rotate said addable weight relatively to said base dumbbell. The rotation may detach a magnetizable chip comprised within said addable weight from a magnet chip comprised within said base dumbbell. Said rotation may be about a pivot located at the center of a surface of said base dumbbell to which said addable weight may be attached. Said addable weight may be made of un-magnetizable material. Said rotation may further locate said magnet chip against an un-magnetizable material, thus the addable weight may be released and removed easily from the base dumbbell.

BRIEF DESCRIPTION OF THE FIGURES

The present invention will be understood and appreciated more fully from the following detailed description taken in conjunction with the figures in which.

Figure 1:
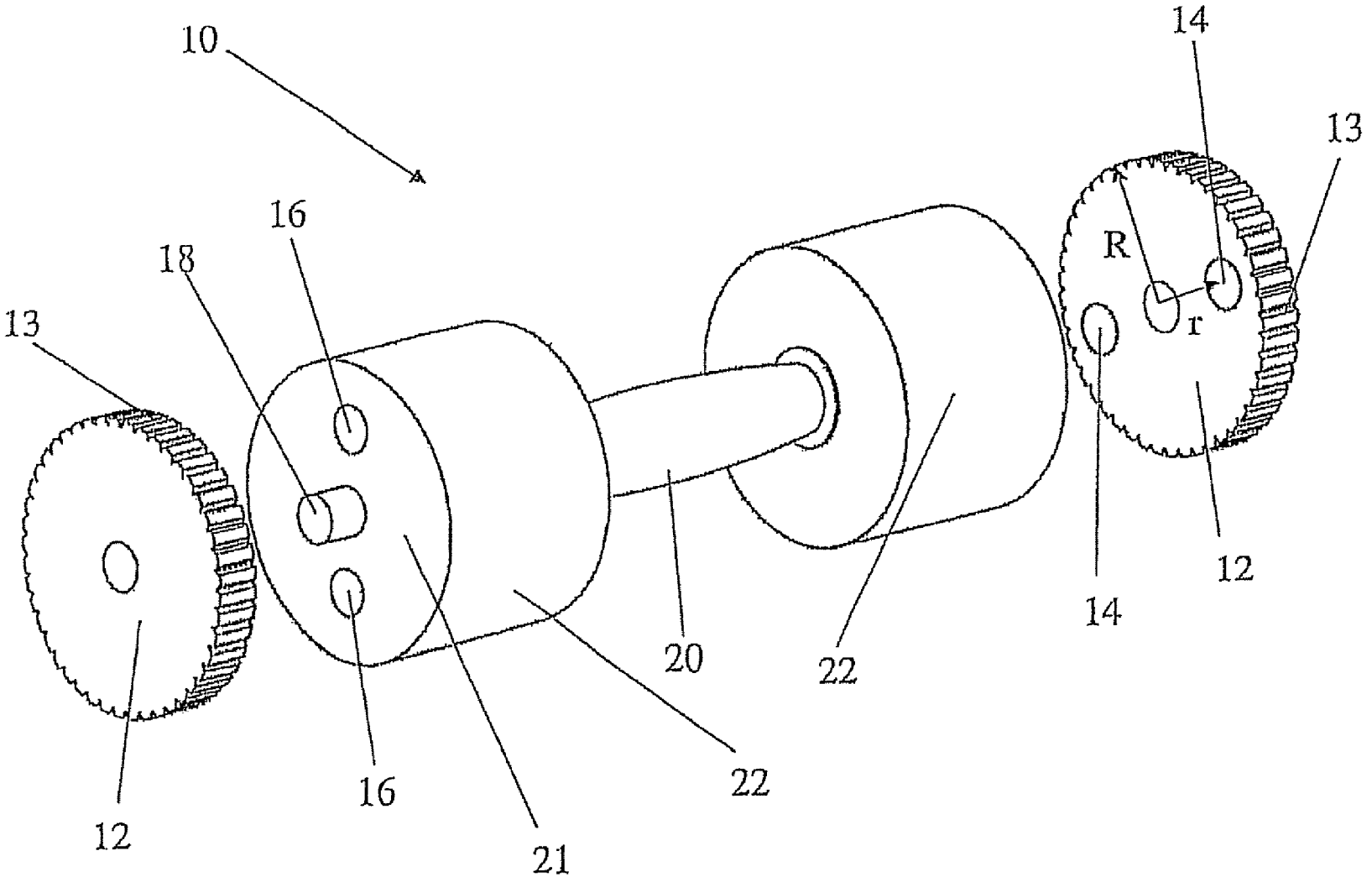
FIG. 1 is a schematic 3-D illustration of an embodiment of a device according to the invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE INVENTION

This invention provides a device in which a rotational motion is used for detaching additional weights from a dumbbell. The linkage between the additional weights to the dumbbell may be strong and safe while the releasing of the additional weights from the dumbbell may be easy and may not require usage of great force.

Attention is made to FIG. 1, which is a schematic 3-D illustration of a device 10 according to some embodiments of the invention. Device 10 may comprise base dumbbell 20 and addable weights 12. Base dumbbell 20 includes end parts 22. Base dumbbell 20 may comprise at least one magnet chip 16 embedded within surface 21 to which an addable weight 12 can be attached. At least part of addable weight 12 may be made of un-magnetizable material. Addable weight 12 may comprise at least one magnetizable chip 14. When comprising more then one magnetizable chip 14, magnetizable chips 14 may be located over an imaginary circle centered substantially at the center of pivot 18 in correspondence with a same number of magnet chips 16 within the surface 21. Addable weight 12 can be attached to base dumbbell 20 by coupling magnetizable chip 14 to magnet chip 16. Rotation of addable weight 12 relatively to surface 21 may detach magnetizable chip 14 from magnet chip 16 using shearing force and may locate magnet chip 16 against the un-magnetizable material, and thus addable weight 12 may be released and removed easily from base dumbbell 20. The rotation of addable weight 12 may be about pivot 18 located substantially at the center of surface 21. The perimeter of addable weight 12 may be jagged with jags 13 in order to facilitate easy gripping and rotating of addable weight 12.

The use of shearing force makes the detaching of magnetizable chip 14 from magnet chip 16 much easier then if pulling force is used. For example, in some embodiments of the invention the shearing force needed in order to detach magnetizable chip 14 from magnet chip 16 may be 0.45 kg, while the pulling force needed in order to detach same magnetizable chip 14 from same magnet chip 16 may be 2 kg. The ratio of the shearing force needed to the pulling force needed depends on parameters like diameter, thickness, and the kind of materials being used, but the sheering force needed is always much smaller then the pulling force needed in order to detach magnetizable chip 14 from magnet chip 16. In some embodiments the ratio of the shearing force needed to the pulling force needed may be about 0.3.

When rotating addable weight 12 about pivot 18, the effect of a lever with length r and a prop point at pivot 18 may decrease the shearing force needed for detaching magnetizable chip 14 from magnet chip 16. The rotation of addable weight 12 may be facilitated by the effect of a lever with length R and a prop point at pivot 18.

Figure 2:
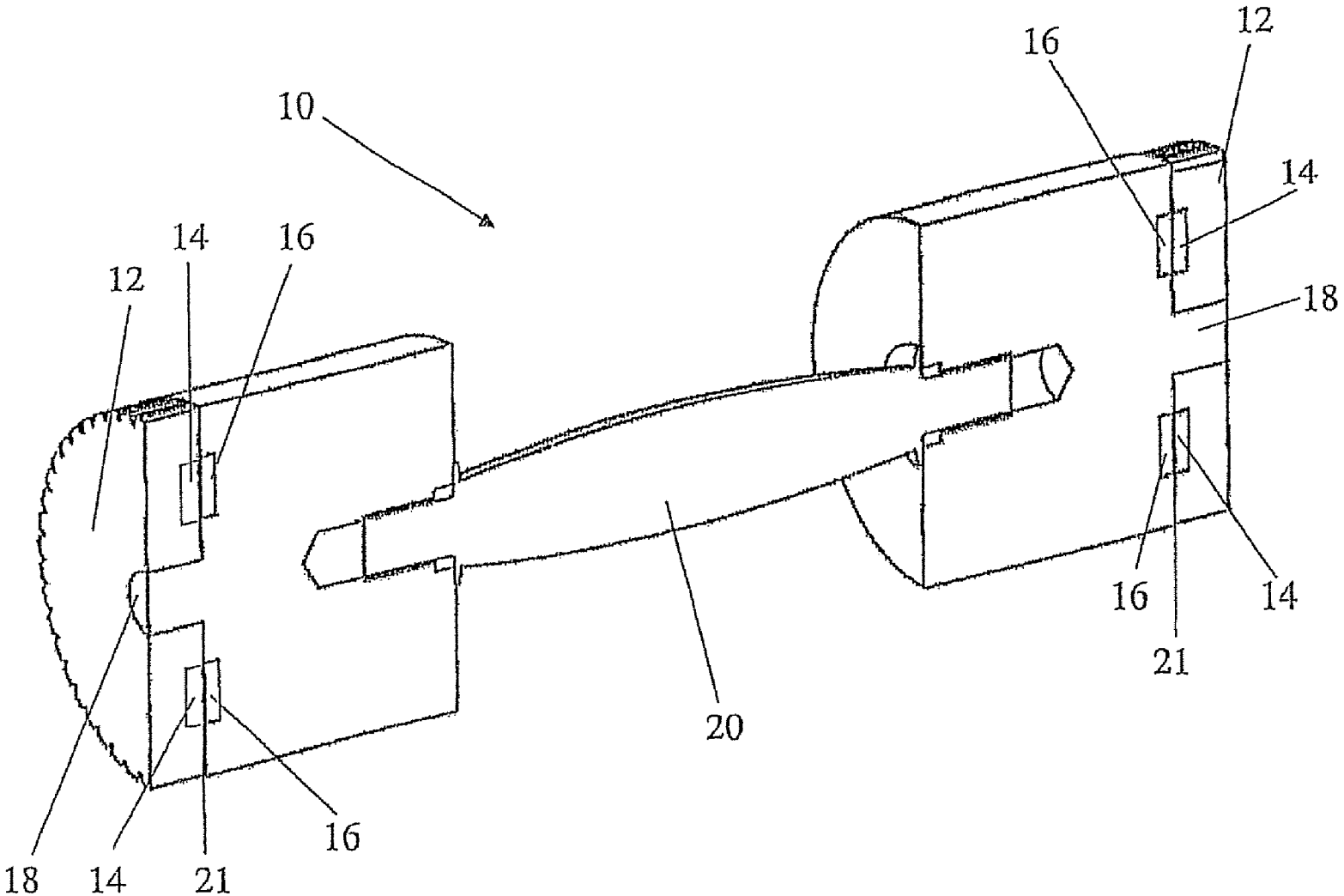
FIG. 2 is a schematic 3-D illustration of a cross section of an embodiment of a device according to the invention.

Attention is made to FIG. 2, which is a schematic 3-D illustration of a cross section of a device 10 according to some embodiments of the invention. Magnet chip 16 may be coplanar with surface 21 and may not protrude out of surface 21. Addable weights 12 may be adapted to rotate about pivot 18.

Figure 3:
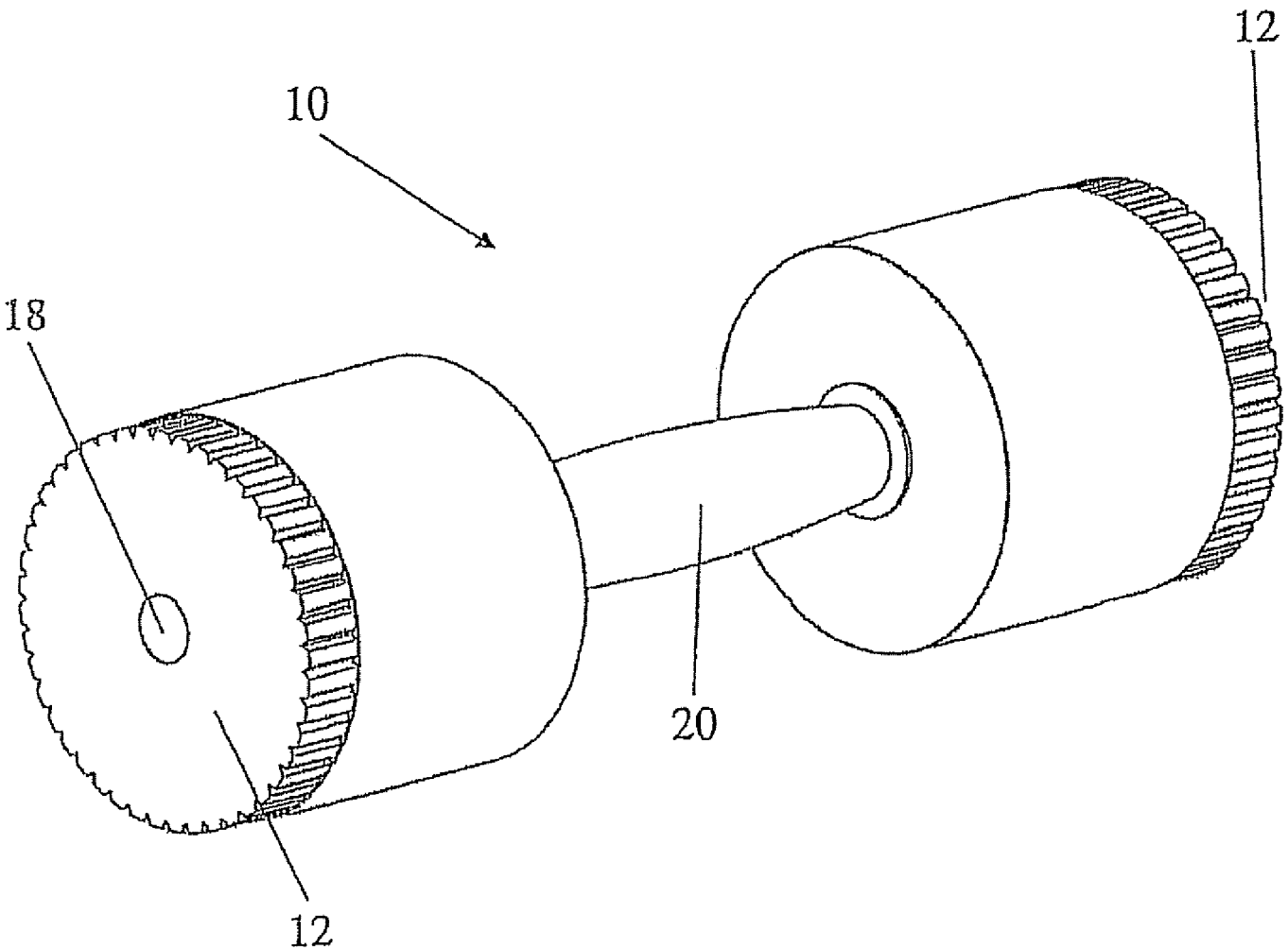
FIG. 3 is a schematic illustration of an embodiment of a device according to the invention.

Attention is made to FIG. 3, which is a schematic illustration of a device 10 according to some embodiments of the invention. Rotation of Addable weight 12 about pivot 18 may release Addable weight 12 from base dumbbell 20. The linkage between additional weights 12 to base dumbbell 20 may be strong and safe while the releasing of additional weights 12 from base dumbbell 20 may be easy and may not require usage of great force.

Figure 4:
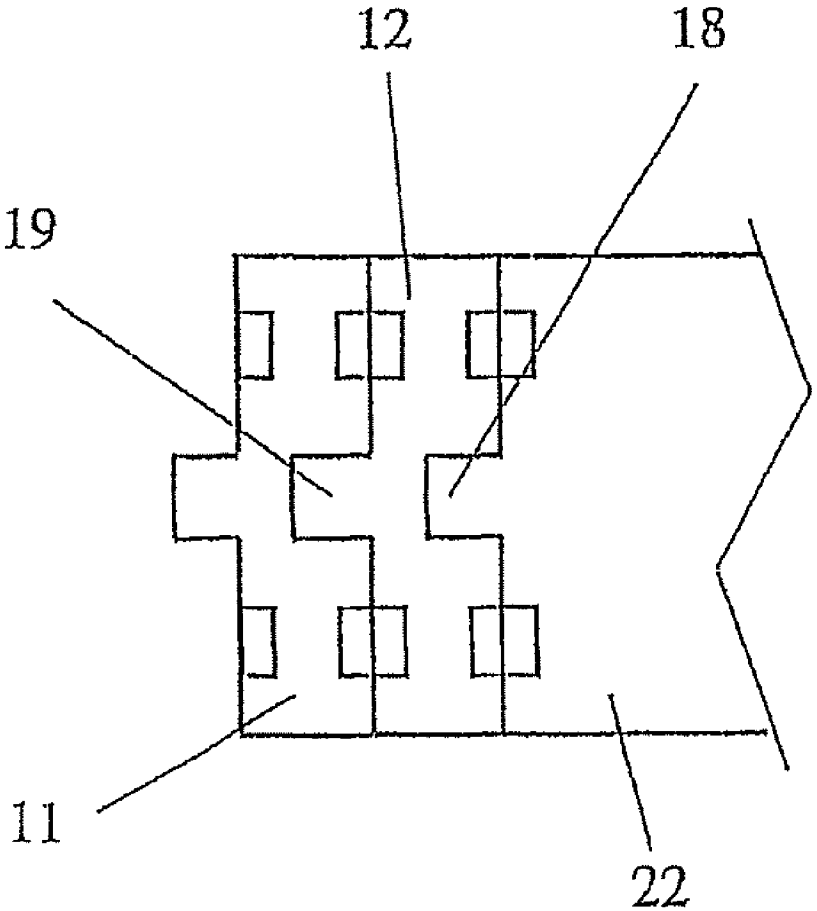
FIG. 4 is a partial schematic illustration of another embodiment of a device according to the invention.

Attention is made to FIG. 4, which is a partial schematic illustration of a device 10 (not shown) according to some embodiments of the invention. Addable weight 12 may be attached to end part 22 of base dumbbell 20 (not shown). Addable weight 12 may rotate about pivot 18. Additional addable weight 11 may be attached to addable weight 12. Addable weight 12 may comprise a central pivot 19 that additional addable weight 11 may be adapted to rotate about. Additional addable weight 11 may require less releasing force then addable weight 12. Further additional addable weights (not shown) may be connected to additional addable weight 11 in a similar way. Smaller required releasing force may be provided by fewer magnets in additional addable weight 11 then in addable weight 12, or by weaker magnets in additional addable weight 13 then in addable weight 12.

The invention claimed is:

1. A device comprising:

a base dumbbell comprising at least one magnet chip within a surface adapted to receive an addable weight; and a first addable weight made of non-magnetizable material comprising at least one magnetizable chip, wherein said addable weight is attachable to said surface of said base dumbbell by coupling said at least one magnetizable chip to said at least one magnet chip, wherein rotation of said addable weight relatively to said surface of said base dumbbell is to detach said at least one magnetizable chip from said at least one magnet chip using shearing force.

2. A device according to claim 1, wherein at least part of said addable weight may be made of un-magnetizable material.

3. A device according to claim 1, wherein said surface comprises a central pivot, and said addable weight is adapted to rotate about said pivot.

4. A device according to claim 3, further comprising one or more addable weights adapted to rotate about said pivot after coupling to said device.

5. A device according to claim 1, wherein a second addable weight is attachable to said first addable weight.

6. A device according to claim 5, wherein each addable weight may further comprise a central pivot, and one or more addable weights are rotatable about said pivot.

7. A device according to claim 5, wherein each addable weight may require less releasing force then the addable weight it may be added to.

8. A device according to claim 1, wherein the perimeter of said first addable weight is jagged.

9. A method comprising the step of:

removing an addable weight from a base dumbbell by rotating said addable weight relatively to said base dumbbell to move a magnetizable chip in said addable weight away from a respective magnet chip in said base dumbbell using shearing force, wherein said rotation is to detach said magnetizable chip from said magnet chip, and wherein said addable weight is made of non-magnetizable material.

10. A method according to claim 9, wherein said rotation is about a pivot located at the center of a surface of said base dumbbell to which said addable weight may be attached.

11. A method according to claim 9, wherein said rotation further locates said magnet chip against an un-magnetizable material.

* * * * *